US012553305B2

(12) United States Patent
Pujol et al.

(10) Patent No.: US 12,553,305 B2
(45) Date of Patent: Feb. 17, 2026

(54) BLOWOUT PREVENTER LOCKING SYSTEM AND METHOD

(71) Applicant: Schlumberger Technology Corporation, Sugar Land, TX (US)

(72) Inventors: Jean-Luc Pujol, Beziers (FR); Gerard Tarbouriech, Beziers (FR)

(73) Assignee: Schlumberger Technology Corporation, Sugar Land, TX (US)

( * ) Notice: Subject to any disclaimer, the term of this patent is extended or adjusted under 35 U.S.C. 154(b) by 30 days.

(21) Appl. No.: 18/641,053

(22) Filed: Apr. 19, 2024

(65) Prior Publication Data

US 2025/0327367 A1 Oct. 23, 2025

(51) Int. Cl.
*E21B 33/06* (2006.01)
*E21B 47/00* (2012.01)

(52) U.S. Cl.
CPC ..... *E21B 33/062* (2013.01); *E21B 47/00* (2013.01)

(58) Field of Classification Search
CPC ..... E21B 33/062; E21B 33/06
See application file for complete search history.

(56) References Cited

U.S. PATENT DOCUMENTS 3,208,357 A 9/1965 Herbert
3,242,826 A 3/1966 Smith
3,941,141 A 3/1976 Robert
4,519,571 A 5/1985 Jones
4,969,390 A 11/1990 Williams, III
5,361,680 A 11/1994 Matsui
6,006,647 A 12/1999 Van Winkle
6,543,594 B1 4/2003 Fuhrer
6,782,799 B2 8/2004 Vincent
7,156,169 B2 * 1/2007 Bartlett ..... E21B 23/0419 166/338
7,300,033 B1 11/2007 Whitby
8,444,109 B2 5/2013 Schaeper
(Continued)

FOREIGN PATENT DOCUMENTS

CN 105416305 A 3/2016
JP 2008069818 A 3/2008
(Continued)

OTHER PUBLICATIONS

Search Report and Written Opinion of International Patent Application No. PCT/US2021/028315 on Jul. 30, 2021; 10 pages.
(Continued)

*Primary Examiner* — Catherine Loikith
(74) *Attorney, Agent, or Firm* — Jeffrey D. Frantz

(57) ABSTRACT

A system includes a blowout preventer (BOP) having a ram assembly having first and second pistons. The first piston is configured to drive a first ram into a cavity of the BOP and the second piston is configured to drive a second ram into the cavity. The system also includes a motor assembly having first and second motors. The first motor is configured to cause an extension of a first lock to constrain the first piston and the second motor is configured to cause an extension of a second lock to constrain the second piston. The first and second motors are fluidly coupled to each other in a series arrangement via a connector conduit. The connector conduit is configured to flow a motor fluid sequentially through the first and second motors.

9 Claims, 6 Drawing Sheets

(56) References Cited

U.S. PATENT DOCUMENTS

| | | | | |
|---|---|---|---|---|
| 9,551,200 | B2 * | 1/2017 | Read | E21B 33/063 |
| 9,957,771 | B2 | 5/2018 | Jaffrey | |
| 10,190,682 | B2 | 1/2019 | Paisley | |
| 10,287,843 | B2 | 5/2019 | Larson | |
| 2008/0048139 | A1 | 2/2008 | Whitby | |
| 2014/0033842 | A1 | 2/2014 | Morin | |
| 2017/0191337 | A1 | 7/2017 | Rey | |
| 2019/0003275 | A1 | 1/2019 | Deul | |
| 2020/0136356 | A1 | 4/2020 | Schall | |
| 2020/0156512 | A1 | 5/2020 | Teraguchi | |
| 2020/0229455 | A1 | 7/2020 | Perez | |
| 2020/0284274 | A1 | 9/2020 | van Kuilenburg | |
| 2022/0136356 | A1 | 5/2022 | Poveda | |
| 2022/0228455 | A1 | 7/2022 | Pujol | |
| 2023/0203907 | A1 | 6/2023 | Pujol | |
| 2024/0240535 | A1 | 7/2024 | Berthaud | |

FOREIGN PATENT DOCUMENTS

| | | | |
|---|---|---|---|
| WO | 2013155206 | A2 | 10/2013 |
| WO | 2020169714 | A1 | 8/2020 |

OTHER PUBLICATIONS

Office Action issued in U.S. Appl. No. 17/996,559 dated Nov. 27, 2024, 16 pages.

International Search Report and Written Opinion issued in International Patent application PCT/US2022/072237 on Sep. 2, 2022, 8 pages.

Notice of Allowance issued in U.S. Appl. No. 17/996,559 dated Feb. 4, 2025, 13 pages.

* cited by examiner

BLOWOUT PREVENTER LOCKING SYSTEM AND METHOD

BACKGROUND

The present disclosure generally relates to systems and methods for locking (e.g., securing) rams of a blowout preventer (BOP).

This section is intended to introduce the reader to various aspects of art that may be related to various aspects of the present disclosure, which are described and/or claimed below. This discussion is believed to be helpful in providing the reader with background information to facilitate a better understanding of the various aspects of the present disclosure. Accordingly, it may be understood that these statements are to be read in this light, and not as admissions of prior art.

BOPs are used to prevent uncontrolled release of a production fluid from a well. One method of preventing the uncontrolled release of production fluid is by causing one or more rams of the BOP to seal the wellbore through which the production fluid flows, and subsequently lock the rams via locks extended via motors. One method of powering the motors used for extending the locks is by using hydraulic motors. However, hydraulic fluid may be lost due to leakage when used to power the hydraulic motors. Additionally, each hydraulic motor generally uses a separate hydraulic fluid, such that the overall hydraulic fluid used by the BOP is a multiple of the number of hydraulic motors.

SUMMARY

A summary of certain embodiments disclosed herein is set forth below. It should be understood that these aspects are presented merely to provide the reader with a brief summary of these certain embodiments and that these aspects are not intended to limit the scope of this disclosure. Indeed, this disclosure may encompass a variety of aspects that may not be set forth below.

In an embodiment, a system includes a blowout preventer (BOP) having a ram assembly having first and second pistons. The first piston is configured to drive a first ram into a cavity of the BOP and the second piston is configured to drive a second ram into the cavity. The system also includes a motor assembly having first and second motors. The first motor is configured to cause an extension of a first lock to constrain the first piston and the second motor is configured to cause an extension of a second lock to constrain the second piston. The first and second motors are fluidly coupled to each other in a series arrangement via a connector conduit. The connector conduit is configured to flow a motor fluid sequentially through the first and second motors.

In another embodiment, a system includes a lock system for a blowout preventer (BOP). The lock system includes a lock assembly having first and second locks. The first lock is configured to selectively lock a first ram of a ram assembly extended into a cavity of the BOP. The second lock is configured to selectively lock a second ram of the ram assembly extended into the cavity of the BOP. The lock system also includes a motor assembly having first and second motors. The first motor is configured to cause the first lock to constrain the first ram. The second motor is configured to cause the second lock to constrain the second ram. The first and second motors are fluidly coupled to each other in a series arrangement via a connector conduit. The connector conduit is configured to flow a motor fluid sequentially through the first and second motors.

In another embodiment, a method includes monitoring conditions in a well to obtain feedback for controlling a blowout preventer (BOP). The method also includes determining a current state of the BOP. The method also includes, in response to determining the BOP to be in an open state and unlocked state, and in response to the feedback meeting a condition for closing the BOP: controlling a ram fluid supply to move first and second rams of the BOP from an open position to a closed position; controlling a motor fluid supply to cause a motor fluid to flow through a motor fluid circuit sequentially through a first motor followed by a second motor; and driving first and second locks via the first and second motors to move the first and second locks from an unlocked position to a locked position relative to the first and second rams. The first and second motors are arranged in a series arrangement.

Various refinements of the features noted above may exist in relation to various aspects of the present disclosure. Further features may also be incorporated in these various aspects as well. These refinements and additional features may exist individually or in any combination. For instance, various features discussed below in relation to one or more of the illustrated embodiments may be incorporated into any of the above-described aspects of the present disclosure alone or in any combination. The brief summary presented above is intended only to familiarize the reader with certain aspects and contexts of embodiments of the present disclosure without limitation to the claimed subject matter.

BRIEF DESCRIPTION OF THE DRAWINGS

These and other features, aspects, and advantages of the present disclosure will become better understood when the following detailed description is read with reference to the accompanying drawings in which like characters represent like parts throughout the drawings, wherein.

DETAILED DESCRIPTION

Figure 1:
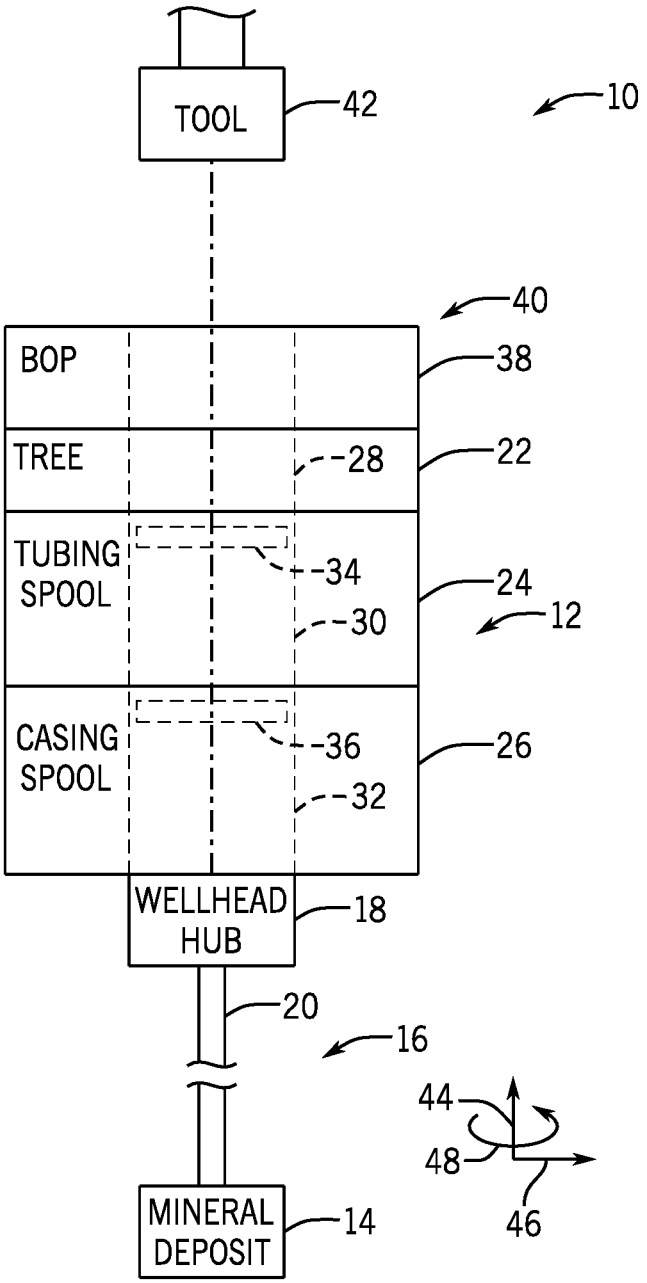
FIG. 1 is a schematic view of a well system having a blowout preventer (BOP) system, according to an embodiment of the present disclosure.

Certain embodiments commensurate in scope with the present disclosure are summarized below. These embodiments are not intended to limit the scope of the disclosure, but rather these embodiments are intended only to provide a brief summary of certain disclosed embodiments. Indeed, the present disclosure may encompass a variety of forms that may be similar to or different from the embodiments set forth below.

As used herein, the term "coupled" or "coupled to" may indicate establishing either a direct or indirect connection (e.g., where the connection may not include or include intermediate or intervening components between those coupled), and is not limited to either unless expressly referenced as such. The term "set" may refer to one or more items. Wherever possible, like or identical reference numerals are used in the figures to identify common or the same elements. The figures are not necessarily to scale and certain features and certain views of the figures may be shown exaggerated in scale for purposes of clarification.

Furthermore, when introducing elements of various embodiments of the present disclosure, the articles "a," "an," and "the" are intended to mean that there are one or more of the elements. The terms "comprising," "including," and "having" are intended to be inclusive and mean that there may be additional elements other than the listed elements. Additionally, it should be understood that references to "one embodiment," "an embodiment," or "some embodiments" of the present disclosure are not intended to be interpreted as excluding the existence of additional embodiments that also incorporate the recited features. Furthermore, the phrase A "based on" B is intended to mean that A is at least partially based on B. Moreover, unless expressly stated otherwise, the term "or" is intended to be inclusive (e.g., logical OR) and not exclusive (e.g., logical XOR). In other words, the phrase A "or" B is intended to mean A, B, or both A and B.

Provided herein is a BOP locking system for locking and unlocking rams of the BOP. The BOP locking system includes two or more motors (e.g., hydraulic motors) fluidly coupled to each other in a series arrangement, such that fluid (e.g., hydraulic fluid) is shared by the motors. In response to first and second pistons and corresponding first and second rams moving from an open position to a closed position, a controller controls a motor fluid supply to cause a fluid (e.g., hydraulic fluid) to sequentially flow through a first motor followed by a second motor, rather than separately flowing the fluid through the first and second motors in a parallel arrangement. In response to the first motor receiving the fluid, the first motor causes a first lock (e.g., rotary lock) to extend from an unlocked position to a locked position to abut the first piston. Additionally or alternatively, in response to the second motor receiving the fluid, the second motor causes a second lock (e.g., rotary lock) to extend from an unlocked position to a locked position to abut the second piston.

Thus, the BOP locking system substantially reduces a volume of the fluid (e.g., hydraulic fluid) used for actuating the first and second locks by using the same fluid (e.g., common hydraulic fluid) for both of the motors and for both a lock cycle and an unlock cycle. In certain embodiments, the lock and unlock cycles may use the same amounts of the fluid; however, a series arrangement of the motors shares the fluid whereas a parallel arrangement of the motors uses different sources of the fluid. For example, a parallel arrangement of the motors may use a total volume of hydraulic fluid ($V_T$) that is approximately equal to the number of motors (M) times a volume of fluid per motor ($V_M$), that is: $V_T=M*V_m$. In contrast, a series arrangement of the motors, which share the same volume of fluid, may have a total volume of fluid $V_T=V_m$. As a result, the series arrangement of motors may use substantially less fluid than parallel arrangement of motors, particularly as the number of motors increases for a BOP. For a M-motor configuration, the series arrangement of motors may use the fluid in a ratio of approximately 1/M as compared with the parallel arrangement of motors. For example, the series arrangement of motors may use approximately ½, ⅓, ¼, or ⅕ the fluid as compared with the parallel arrangement of motors for M-motor configurations with 2, 3, 4, or 5 motors (M). The foregoing examples are merely intended to illustrate the fluid savings by using a series arrangement of the motors, and it should be appreciated that the actual fluid use may vary.

Additionally provided herein is a method for operating the BOP locking system. The method includes monitoring conditions in a well to obtain feedback for controlling the BOP. The method also includes determining a current state of the BOP. In response to determining the BOP to be in an open state and unlocked state, and in response to the feedback meeting a condition for closing the BOP, a ram fluid supply is controlled to move first and second rams of the BOP from an open position to a closed position. Additionally, in response to determining the BOP to be in an open state and unlocked state, and in response to the feedback meeting a condition for closing the BOP, a motor fluid supply is controlled to cause a motor fluid to flow through a motor fluid circuit sequentially through a first motor followed by a second motor. The first and second motors are arranged in a series arrangement. Additionally, in response to determining the BOP to be in an open state and unlocked state, and in response to the feedback meeting a condition for closing the BOP, first and second ram locks are driven via the first and second motors to move the first and second ram locks from an unlocked position to a locked position relative to the first and second rams.

FIG. 1 is a block diagram of an embodiment of a mineral extraction system 10. The mineral extraction system 10 may be utilized to extract various natural resources (e.g., hydrocarbons, such as oil and/or natural gas) from the earth. As illustrated, the mineral extraction system 10 includes a wellhead 12 coupled to a mineral deposit 14 via a well 16. The well 16 may include a wellhead hub 18 and a wellbore 20. The wellhead hub 18 generally includes a large diameter hub disposed at an end of the wellbore 20 and is configured to connect the wellhead 12 to the wellbore 20. As will be appreciated, the wellbore 20 may contain elevated pressures. For example, the wellbore 20 may include pressures that exceed 10,000, 15,000, or even 20,000 pounds per square inch (psi). Accordingly, the mineral extraction system 10 may employ various mechanisms, such as seals, plugs, and valves, to control and regulate the well 16.

In the illustrated embodiment, the mineral extraction system 10 includes a tree 22, a tubing spool 24, a casing spool 26, and a blowout preventer (BOP) 38 having a BOP locking system 40. The tree 22 generally includes a variety of flow paths (e.g., bores), valves, fittings, and controls for operating the well 16. Further, the tree 22 may provide fluid communication with the well 16. For example, the tree 22 includes a tree bore 28 that provides for completion and workover procedures, such as the insertion of tools into the well 16, the injection of various chemicals into the well 16, and so forth. Further, the natural resources extracted from the well 16 may be regulated and routed via the tree 22. For example, the tree 22 may be coupled to a flowline that is tied back to other components, such as a manifold.

As shown, the tubing spool 24 may provide a base for the tree 22 and includes a tubing spool bore 30 that connects (e.g., enables fluid communication between) the tree bore 28 and the well 16. As shown, the casing spool 26 may be positioned between the tubing spool 24 and the wellhead hub 18 and includes a casing spool bore 32 that connects (e.g., enables fluid communication between) the tree bore 28 and the well 16. Thus, the tubing spool bore 30 and the casing spool bore 32 may provide access to the wellbore 20 for various completion and workover procedures. The BOP 38 may consist of a variety of valves, fittings, and controls to block oil, gas, or other fluid from exiting the well 16 in the event of an unintentional release of pressure or an overpressure condition.

As shown, a tubing hanger 34 is positioned within the tubing spool 24. The tubing hanger 34 may be configured to support tubing (e.g., a tubing string) that is suspended in the wellbore 20 and/or to provide a path for control lines, hydraulic control fluid, chemical injections, and so forth. Additionally, as shown, a casing hanger 36 is positioned within the casing spool 26. The casing hanger 36 may be configured to support casing (e.g., a casing string) that is suspended in the wellbore 20. A tool 42 (e.g., hydraulic tool) may be utilized to lower the tubing hanger 34 into the tubing spool 24 and/or the casing hanger 36 into the casing spool 26. As discussed in more detail below, a seal system (e.g., a setting system) may provide a seal (e.g., annular seal) between the tubing hanger 34 and the tubing spool 24 and/or a seal (e.g., annular seal) between the casing hanger 36 and the casing spool 26. To facilitate discussion, the mineral extraction system 10, and the components therein, may be described with reference to an axial axis or direction 44, a radial axis or direction 46, and a circumferential axis or direction 48.

Figure 2:
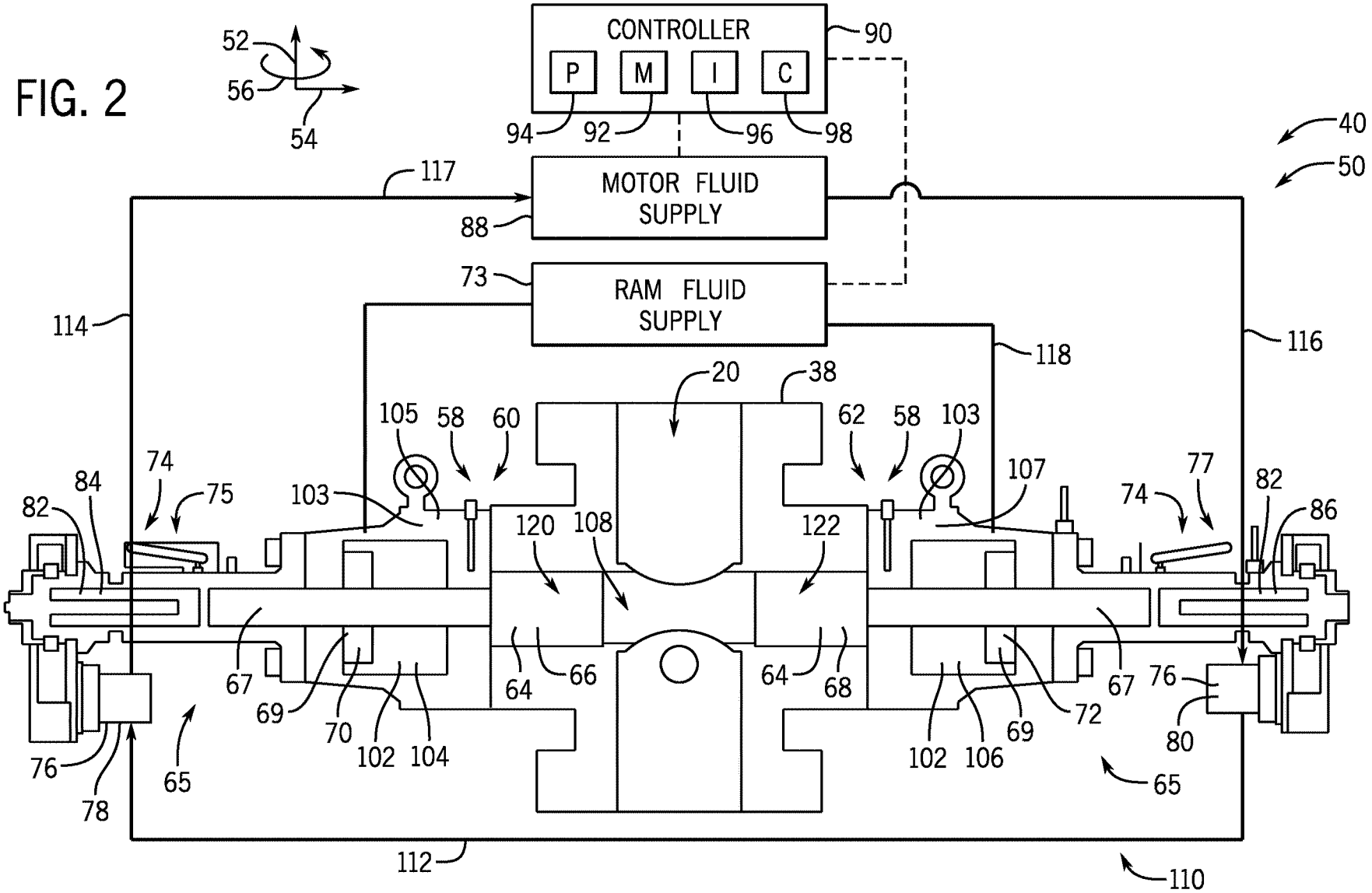
FIG. 2 is a schematic view of the BOP system of FIG. 1 in an open and unlocked configuration, according to an embodiment of the present disclosure.

FIG. 2 is a schematic view of the BOP locking system 40 of FIG. 1 in an open and unlocked configuration 50. As illustrated, the BOP locking system 40 may be described in relation to a vertical direction or axis 52, a radial direction or axis 54, and a circumferential direction 56. As shown, the BOP locking system 40 includes ram assemblies 58 (e.g., first ram assembly 60, second ram assembly 62), with each ram assembly 58 having a ram 64 (e.g., first ram 66, second ram 68). In the illustrated embodiment, each ram assembly 58 additionally includes a piston assembly 65 having a shaft 67 coupled to a piston 69 (e.g., first piston 70, second piston 72), such as an annular piston. As shown, a ram fluid supply 73 is fluidly coupled to the first ram assembly 60 and the second ram assembly 62. The BOP locking system 40 also includes motor assemblies 74 (e.g., first motor assembly 75, second motor assembly 77), such that each motor assembly 74 includes a motor 76 (e.g., first motor 78, second motor 80) and a lock 82 (e.g., first lock 84, second lock 86). The motors 76 may include fluid-driven rotary motors, fluid-driven reciprocating piston-cylinder motors, or other fluid-driven motors that can operate in first and second opposite directions of fluid flow. As shown, a motor fluid supply 88 is fluidly coupled to the first motor 78 of the first motor assembly 75, as well as the second motor 80 of the second motor assembly 77. In the illustrated embodiment, the BOP locking system 40 also includes a controller 90 having a memory 92 and a processor 94. The processor 94 may execute instructions 96 stored in the memory 92 and may communicate with various sensors and equipment via communication circuitry 98. As shown, the controller 90 is communicatively coupled to the ram fluid supply 73 and the motor fluid supply 88. The first motor 78 may cause either an extension or a retraction of the first lock 84, and the second motor 80 may cause either an extension or a retraction of the second lock 86. As discussed herein, the extension of the first lock 84 constrains the first piston 70 (e.g., via abutting an axial end of the shaft 67) at least along the radial axis 54, and the extension of the second lock 86 constrains the second piston 72 (e.g., via abutting an axial end of the shaft 67) at least along the radial axis 54. In certain embodiments, the motors 76 may include fluid-drive motors (e.g., hydraulic motors). Additionally or alternatively, in certain embodiments, the locks 82 may include rotary locks (e.g., threaded locks, such as locking screws). For example, the locks 82 (e.g., rotary locks) may rotate (e.g., along threads) to move along a central axis of the locks 82, such as in the radial direction 54. In certain embodiments, the locks 82 may include wedge locks.

In the illustrated embodiment, the BOP 38 includes the wellbore 20 (e.g., bore) through which production fluid may flow. The BOP 38 additionally includes a ram cavity 108 that intersects the wellbore 20 in a crosswise direction. As shown, the ram assemblies 58 include cylinders 102 (e.g., first cylinder 104, second cylinder 106) disposed in bonnets 103 (e.g., first bonnet 105, second bonnet 107) of the BOP 38. As discussed herein, the first ram 66 and the second ram 68 axially translate through the ram cavity 108 to block production fluid from flowing past the rams 64.

In the illustrated embodiment, the motor assembly 74 includes a motor fluid circuit 110. The motor fluid circuit 110 includes a connector conduit 112 that fluidly couples the first motor 78 and the second motor 80. As shown, the motor fluid circuit 110 also includes a first supply conduit 114 that fluidly couples the first motor 78 and the motor fluid supply 88. Additionally, the motor fluid circuit 110 includes a second supply conduit 116 that fluidly couples the second motor 80 and the motor fluid supply 88. That is, the motor fluid supply 88 is fluidly coupled to both the first motor 78 and the second motor 80, and supplies a hydraulic motor fluid 117 (e.g., hydraulic fluid) to the first motor 78 and the second motor 80. In certain embodiments, the hydraulic motor fluid 117 may include a hydraulic oil or, in some embodiments, a gaseous fluid. The motor fluid supply 88 may include one or more fluid tanks, pumps, valves, flow meters, pressure regulators, filters, sensors (e.g., pressure sensors, temperature sensors, etc.), or any combination thereof.

In the illustrated embodiment, the first piston 70 is disposed in the first cylinder 104, and the second piston 72 is disposed in the second cylinder 106. As shown, the first ram 66 is coupled to the first piston 70, and the second ram 68 is coupled to the second piston 72. The ram fluid supply 73 is fluidly coupled to the pistons 69 and supplies a hydraulic ram fluid 118 (e.g., ram fluid, hydraulic fluid) to the pistons 69. In certain embodiments, the hydraulic ram fluid 118 may include a hydraulic oil or, in some embodiments, a gaseous fluid. In the illustrated embodiment, the rams 64 are retracted in the ram cavity 108, such that neither the first ram 66 nor the second ram 68 block a portion of the wellbore 20 of the BOP 38. That is, the first ram 66 is disposed in a first side 120 of the ram cavity 108 in an open position, and the second ram 68 is disposed in a second side 122 of the ram cavity 108 in an open position. The ram fluid supply 73 may include one or more fluid tanks, pumps, valves, flow meters, pressure regulators, filters, sensors (e.g., pressure sensors, temperature sensors, etc.), or any combination thereof.

As shown, the first motor 78 and the second motor 80 are arranged in a series arrangement along the motor fluid circuit 110. That is, the first motor 78 and the second motor 80 are sequentially fluidly coupled to the motor fluid circuit 110 via the connector conduit 112, such that the motor fluid 117 sequentially flows through the second motor 80 followed by the first motor 78 or, in certain embodiments, through the first motor 78 followed by the second motor 80. In the illustrated embodiment, the motor fluid 117 is shown as flowing from the motor fluid supply 88 to the second motor 80 via the second supply conduit 116, from the second motor 80 to the first motor 78 via the connector conduit 112, and from the first motor 78 back to the motor fluid supply 88 via the first supply conduit 114. The first lock 84 is positioned in a retracted position (e.g., unlocked position) relative to the first piston 70 (e.g., offset from an axial end of the shaft 67) in response to the first motor 78 receiving the motor fluid 117 from the second motor 80 via the connector conduit 112. The second lock 86 is positioned in a retracted position relative to the second piston 72 (e.g., offset from an axial end of the shaft 67) in response to the second motor 80 receiving the motor fluid 117 from the motor fluid supply 88 via the second supply conduit 116. In the illustrated embodiment, the first and second motors 78 and 80 use the same motor fluid 117 in the same motor fluid circuit 110, rather than using separate motor fluids in separate parallel motor fluid circuits. Thus, the first motor 78 and the second motor 80 can be operated to actuate the locks 82 (e.g., first lock 84, second lock 86) using the same motor fluid 117 in a first direction through the motor fluid circuit 110 or in an opposite second direction through the motor fluid circuit 110.

In certain embodiments, the BOP locking system 40 may include more than two ram assemblies 58 and/or more than two corresponding motor assemblies 74. For example, BOP locking system 40 may include 3, 4, 5, 6, 7, 8 or more ram assemblies 58, as well as 3, 4, 5, 6, 7, 8, or more corresponding motor assemblies 74, such that the number of ram assemblies 58 matches the number of motor assemblies 74. As with the embodiment of two motor assemblies 74, each of the three or more motor assemblies 74 may be fluidly coupled in a series arrangement, such that the motor fluid supply 88 is fluidly coupled to a first motor assembly, a last motor assembly, and any number of intermediate motor assemblies in the series arrangement. In certain embodiments, each ram assembly 58 may include one or more redundant motor assemblies 74, in the event that one motor assembly 74 malfunctions. For example, one or more ram assemblies 58 may include 2, 3, 4, or more corresponding motor assemblies 74. The series arrangement of the motor assemblies 74 reduces the volume of motor fluid 117 used to actuate the locks 82 via the motor assemblies 74, simplifies and reduces the amount of conduits for operating the motor assemblies 74, and thus also reduces the number of possible leak points in the motor fluid circuit 110.

Figure 3:
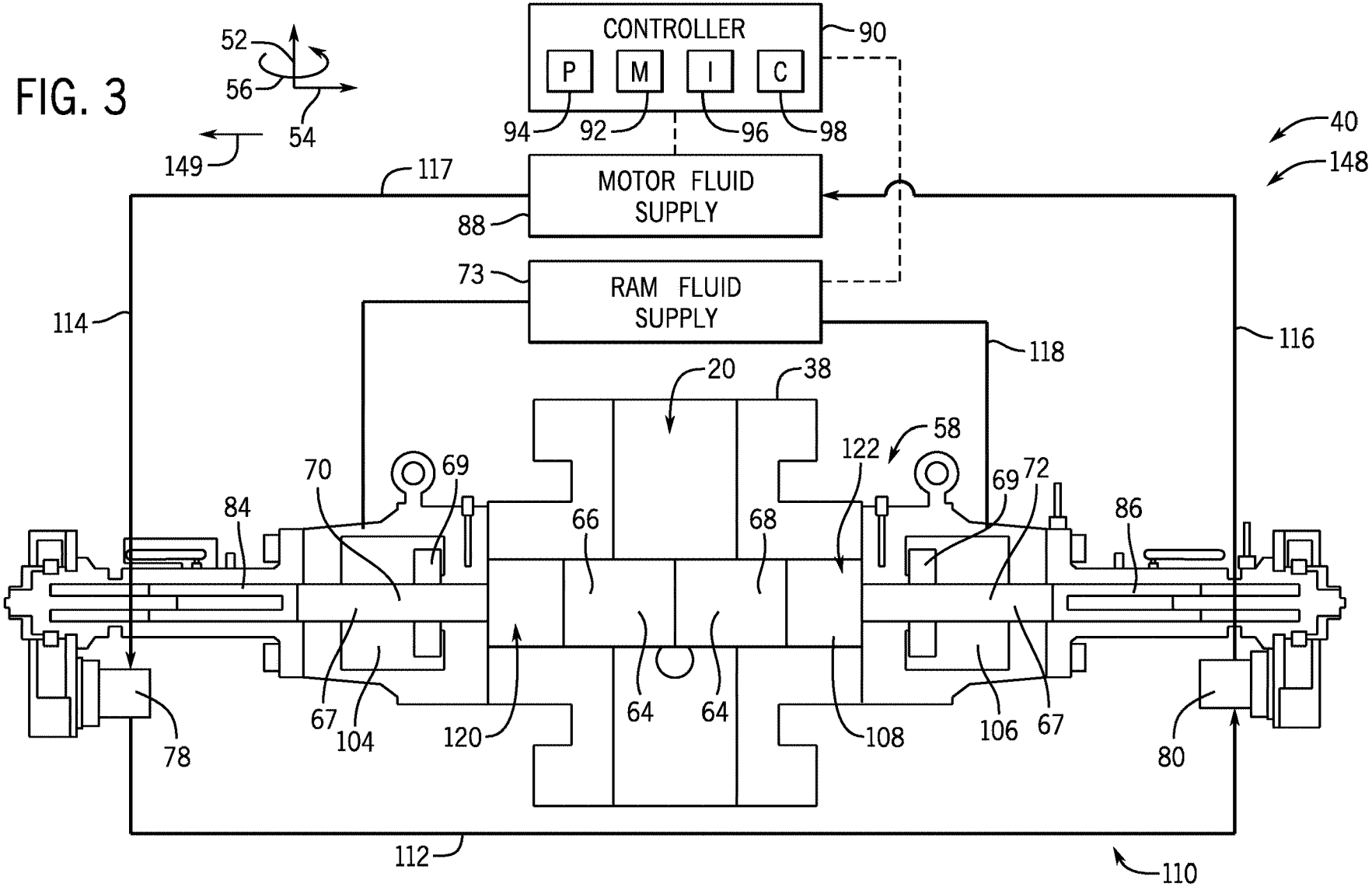
FIG. 3 is a schematic view of the BOP system of FIG. 1 in a closed and locked configuration, according to an embodiment of the present disclosure.

FIG. 3 is a schematic view of the BOP locking system 40 of FIG. 1 in a closed and locked configuration 148. In the illustrated embodiment, the first piston 70 has shifted in the radial direction 54 within the first cylinder 104 in response to the first cylinder 104 receiving the hydraulic ram fluid 118 from the ram fluid supply 73. Additionally, the second piston 72 has shifted in a radial direction 149 (e.g., opposed to the radial direction 54) within the second cylinder 106 in response to the second cylinder 106 receiving the hydraulic ram fluid 118 from the ram fluid supply 73. As shown, the first piston 70 has driven the first ram 66 into the wellbore 20 of the BOP 38, and the second piston 72 has driven the second ram 68 into the wellbore 20. In other words, the first and second pistons 70 and 72 have been driven inwardly toward the wellbore 20, thereby driving the first and second rams 66 and 68 inwardly into the wellbore 20.

In the illustrated embodiment, the first piston 70 is disposed in the first cylinder 104, and the second piston 72 is disposed in the second cylinder 106. As shown, the first ram 66 is coupled to the shaft 67 of the first piston 70, and the second ram 68 is coupled to the shaft 67 of the second piston 72. The ram fluid supply 73 is fluidly coupled to the cylinders 102 having the pistons 69 and supplies a hydraulic ram fluid 118 (e.g., ram fluid, hydraulic fluid) to the cylinders 102 having the pistons 69, thereby driving the pistons 69 in the cylinders 102. In certain embodiments, the hydraulic ram fluid 118 may include a hydraulic oil or, in some embodiments, a gaseous fluid. In the illustrated embodiment, the pistons 69 drive the rams 64 to extend from the ram cavity 108 into the wellbore 20 of the BOP, such that the first ram 66 and the second ram 68 block the wellbore 20. That is, the first piston 70 drives the first ram 66 from a retracted position (e.g., open position) in the first side 120 of the ram cavity 108 to an extended position (e.g., closed position) in the wellbore 20, such that the first ram 66 is at least partially disposed in the wellbore 20 in the extended position. Additionally, the second piston 72 drives the second ram 68 from a retracted position (e.g., open position) in the second side 122 of the ram cavity 108 to an extended position (e.g., closed position) in the wellbore 20, such that the second ram 68 is at least partially disposed in the wellbore 20 in the extended position.

As shown, the first motor 78 and the second motor 80 are arranged in a series arrangement along the motor fluid circuit 110. That is, the first motor 78 and the second motor 80 are sequentially fluidly coupled to the motor fluid circuit 110 via the connector conduit 112, such that the motor fluid 117 sequentially flows through the first motor 78 followed by the second motor 80, or through the second motor 80 followed by the first motor 78. In the illustrated embodiment, the motor fluid 117 is shown as flowing from the motor fluid supply 88 to the first motor 78 via the first supply conduit 114, from the first motor 78 to the second motor 80 via the connector conduit 112, and from the second motor 80 back to the motor fluid supply 88 via the second supply conduit 116. The first lock 84 extends to an extended position (e.g., locked position against the axial end of the shaft 67) from a retracted position (e.g., unlocked position offset away from the axial end of the shaft 67) relative to the first piston 70 in response to the first motor 78 receiving the motor fluid 117 from the motor fluid supply 88 via the first supply conduit 114. Additionally, the second lock 86 extends to an extended position (e.g., locked position against the axial end of the shaft 67) from a retracted position (e.g., unlocked position offset away from the axial end of the shaft 67) relative to the second piston 72 in response to the second motor 80 receiving the motor fluid 117 from the first motor 78 via the connector conduit 112. That is, the first lock 84 constrains (e.g., locks) the first piston 70 at least along the radial axis 54 by extending in the radial direction 54 and axially abutting the axial end of the shaft 67 of the first piston 70. Additionally, the second lock 86 constrains the second piston 72 at least along the radial axis 54 by extending in the radial direction 149 and axially abutting the axial end of the shaft 67 of the second piston 72.

Figure 4:
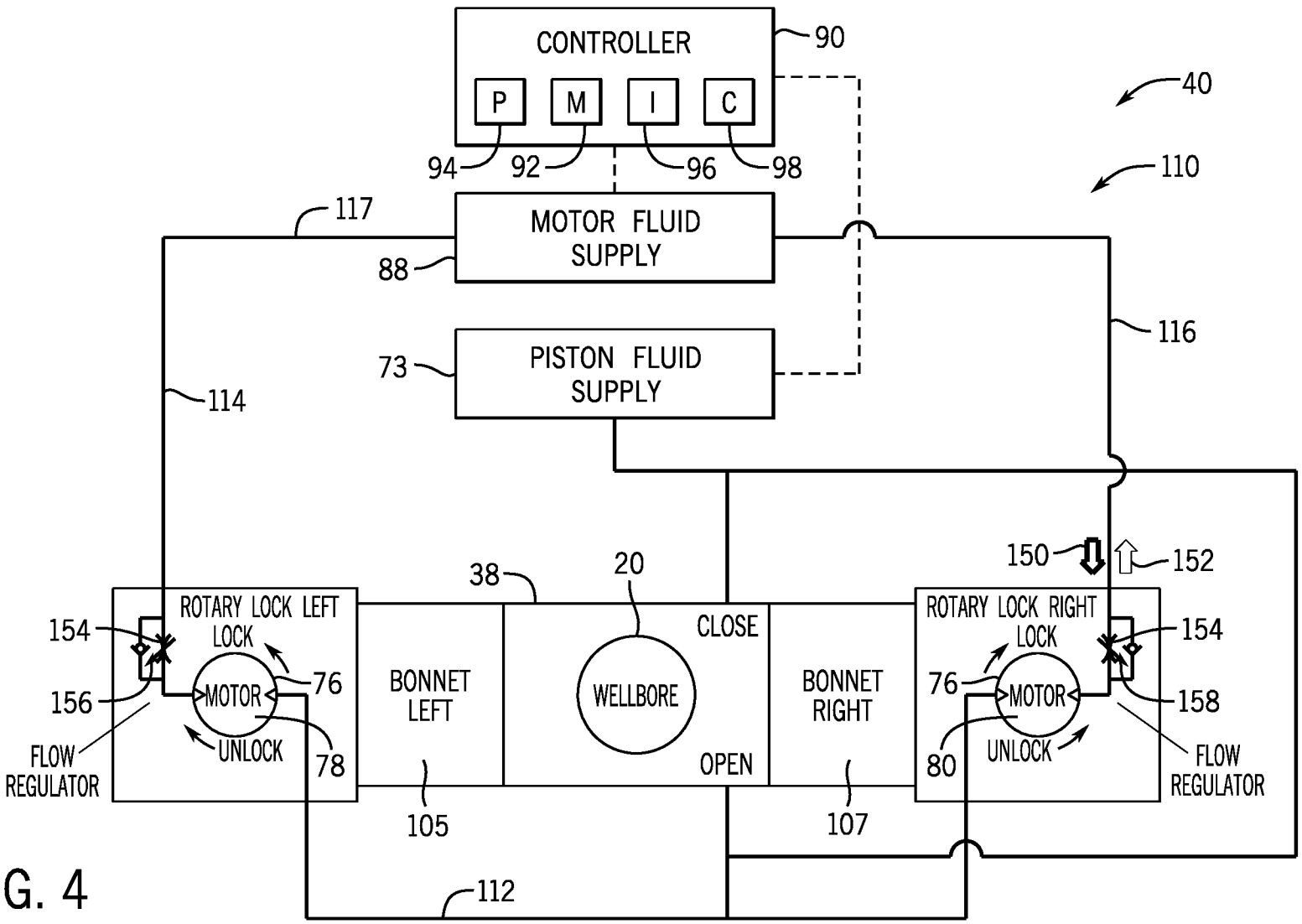
FIG. 4 is a diagrammatical view of the BOP system of FIG. 1 showing a first motor fluidly coupled to a second motor in a series arrangement, according to an embodiment of the present disclosure.

FIG. 4 is a diagrammatical view of the BOP locking system 40 of FIG. 1 showing the first motor 78 fluidly coupled to the second motor 80 in a series arrangement. In the illustrated embodiment, the wellbore 20 (e.g., central main bore) of the BOP 38 is disposed between the first bonnet 105 and the second bonnet 107. In the illustrated embodiment, the motor fluid circuit 110 includes the connector conduit 112 that fluidly couples the first motor 78 and the second motor 80. As shown, the motor fluid circuit 110 also includes the first supply conduit 114 that fluidly couples the first motor 78 and the motor fluid supply 88. Additionally, the motor fluid circuit 110 includes the second supply conduit 116 that fluidly couples the second motor 80 and the motor fluid supply 88. That is, the motor fluid supply 88 is fluidly coupled to both the first motor 78 and the second motor 80 in a closed loop defined by the conduits 112, 114, and 116 and flow paths through the first and second motors 78 and 80 of the motor fluid circuit 110. The motor fluid supply 88 may supply the hydraulic motor fluid 117 (e.g., hydraulic fluid) to either the first motor 78 or the second motor 80, and also receives the hydraulic motor fluid 117 from either the first motor 78 or the second motor 80. For example, the motor fluid supply 88 may supply the hydraulic motor fluid 117 to the first motor 78 and may receive the hydraulic motor fluid 117 from the second motor 80 in a first flow direction through the motor fluid circuit 110 (e.g., closed loop). Additionally or alternatively, the motor fluid supply 88 may supply the hydraulic motor fluid 117 to the second motor 80 and may receive the hydraulic motor fluid 117 from the first motor 78 in a second flow direction opposite to the first flow direction through the motor fluid circuit 110 (e.g., closed loop). In certain embodiments, the hydraulic motor fluid 117 may include a hydraulic oil or, in some embodiments, a gaseous fluid.

In the illustrated embodiment, the motor fluid circuit 110 is shown as enabling the hydraulic motor fluid 117 to flow in either a clockwise direction 150 (e.g., to the second motor 80 followed by the first motor 78) or a counter clockwise direction 152 (e.g., to the first motor 78 followed by the second motor 80) through the motor fluid circuit 110 (e.g., closed loop). In response to the hydraulic motor fluid 117 flowing through the motor fluid circuit 110 in the counter clockwise direction 152, the first motor 78 causes the first lock 84 to extend into an extended (e.g., locked) position against an axial end of the shaft 67 of the first piston 70, and the second motor 80 causes the second lock 86 to extend into the extended position against an axial end of the shaft 67 of the second piston 72. In response to the hydraulic motor fluid 117 flowing through the motor fluid circuit 110 in the clockwise direction 150, the second motor 80 causes the second lock 86 to retract into the second bonnet 107 in the retracted position offset away from an axial end of the shaft 67 of the second piston 72, and the first motor 78 sequentially causes the first lock 84 to retract into the first bonnet 105 in the retracted (e.g., unlocked) position offset away from an axial end of the shaft 67 of the first piston 70.

In the illustrated embodiment, the motor fluid circuit 110 includes flow regulators 154 (e.g., first flow regulator 156, second flow regulator 158), which may regulate the flow (e.g., flow rate) of the hydraulic motor fluid 117 flowing through the motor fluid circuit 110. In certain embodiments, the flow regulators 154 may be unidirectional flow regulators. In certain embodiments, the first flow regulator 156 and the second flow regulator 158 may both regulate the flow of the hydraulic motor fluid 117. In certain embodiments, the first flow regulator 156 may regulate the flow of the hydraulic motor fluid 117 when the hydraulic motor fluid 117 flows in the counter clockwise direction 152, and the second flow regulator 158 may regulate the flow of the hydraulic motor fluid 117 when the hydraulic motor fluid 117 flows in the clockwise direction 150. In the illustrated embodiment, the flow regulators 154 are shown as being proximate to the motors 76. In certain embodiments, the flow regulators 154 may be disposed at other locations throughout the motor fluid circuit 110.

It may be appreciated that the series arrangement of the first motor 78 and the second motor 80 in the motor fluid circuit 110 may reduce the amount (e.g., volume) of the hydraulic motor fluid 117 used during locking and unlocking cycles of the BOP locking system 40. For example, in certain embodiments, the series arrangement of the motors 76 discussed herein may use less than 20, 19, 18, 17, 16, 15, 14, or 13 liters of the hydraulic motor fluid 117 for both extending (e.g., locking) and retracting (e.g., unlocking) the locks 82. That is, in certain embodiments, the series arrangement of the motors 76 discussed herein may use less than 10, 9, 8, 7, 6, or 5 liters of the hydraulic motor fluid 117 for retracting the locks 82, and less than 10, 9, 8, 7, 6, or 5 liters of the hydraulic motor fluid 117 for extending the locks 82. In certain embodiments, the series arrangement of the motors 76 may reduce the amount of hydraulic motor fluid 117 by at least 50, 60, 70, 80, or 90 percent relative to a parallel arrangement of the motors 76 (i.e., separate fluid circuits for the different motors 76). Additionally, it may be appreciated that the reduction (e.g., savings) in the amount of hydraulic motor fluid 117 increases when additional motors 76 are used. For example, the proportion (e.g., ratio) of hydraulic motor fluid 117 that is used for three motors 76 in series compared to three motors 76 in parallel is smaller than the proportion of hydraulic motor fluid 117 that is used for two motors 76 in series compared to two motors 76 in parallel.

Additionally, it may be appreciated that the series arrangement of the first motor 78 and the second motor 80 in the motor fluid circuit 110 may reduce the quantities of certain hardware, thereby reducing the overall cost. For example, in certain embodiments, the series arrangement of the first motor 78 and the second motor 80 in the motor fluid circuit 110 may use two flow regulators 154. Additionally, the series arrangement of the first motor 78 and the second motor 80 may use one supply hose (e.g., connector conduit 112) that transfers the motor hydraulic fluid 117 between the first motor 78 and the second motor 80. It may be appreciated that the reduced number of supply hoses reduces the number of connections and reduces the loss (e.g., leakage) of the hydraulic motor fluid 117. The series arrangement of the first motor 78 and the second motor 80 also may eliminate various redundant components typically needed for a parallel arrangement of motors, such as redundant fluid supplies (e.g., pumps, tanks, valves, etc.), redundant sensors, or any combination thereof.

Figure 5:
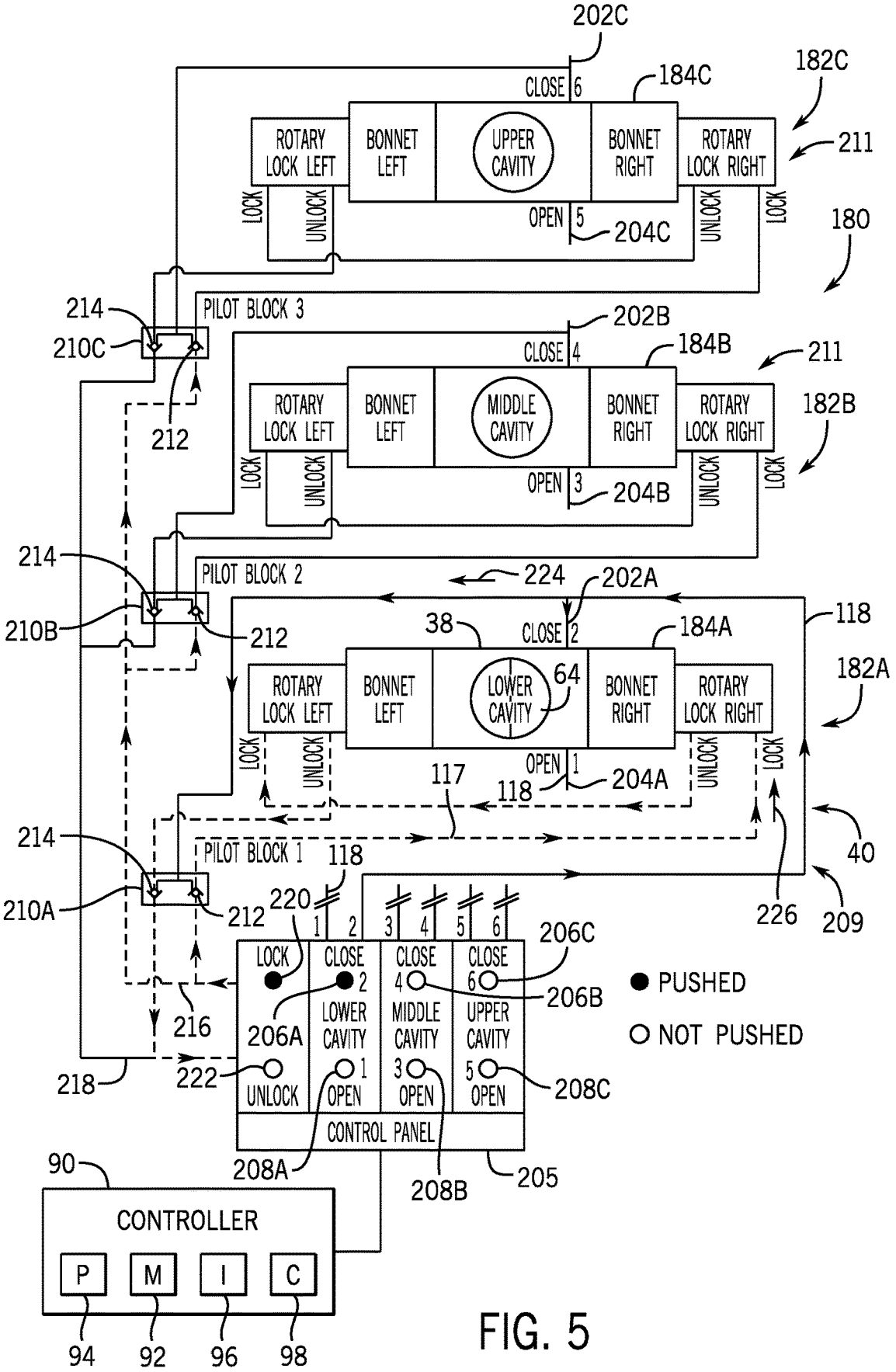
FIG. 5 is a diagrammatical view of a BOP stack having multiple BOP systems, according to an embodiment of the present disclosure.

FIG. 5 is a diagrammatical view of a BOP stack 180 having a plurality of BOP systems 182 (e.g., BOP system 182A, 182B, and 182C). Each of the BOP systems 182 generally operates the same as discussed above with reference to FIGS. 2-4, wherein the locks 82 (e.g., rotary locks) are actuated by motors 76 (e.g., hydraulic motors) that are disposed and actuated in a series arrangement in a motor fluid circuit 110. Thus, all aspects of the series arrangement and actuation of the motors 76 coupled to the locks 82 applies to each of the illustrated BOP systems 182. As illustrated in FIG. 5, the series arrangement of motors 76 is used in context of the BOP stack 180 along with a pilot block system for operating the plurality of BOP systems 182 (e.g., BOP system 182A, 182B, and 182C).

As shown, the BOP stack 180 includes a plurality of BOPs 184 (e.g., BOP 184A, 184B, and 184C). Each BOP 38 of the plurality of BOPs 184 includes its own BOP locking system 40. As shown, the BOP 184A includes the BOP system 182A, the BOP 184B includes the BOP system 182B, and the BOP 184C includes the BOP system 182C. It may be appreciated that the BOP stack 180 may include any number of BOPs 38. Each BOP 38 is associated with a respective close line 202, such as a first close line 202A for the first BOP 184A, a second close line 202B for the second BOP 184B, and a third close line 202C the third BOP 184C. Additionally, each BOP 38 is associated with a respective open line 204, such as a first open line 204A for the first BOP 184A, a second open line 204B for the second BOP 184B, and a third open line 204C the third BOP 184C.

As shown, the controller 90 may be communicatively coupled to a control panel 205. The control panel 205 may include input devices 206, 208, such as a first close input device 206A and a first open input device 208A for the first BOP 184A, a second close input device 206B and a second open input device 208B for the second BOP 184B, and a third close input device 206C and a third open input device 208C for the third BOP 184C. In operation, an operator may provide a close input to the first close input device 206A, which may cause a flow of hydraulic ram fluid 118 to a respective portion of the first BOP 184A to transition or drive the rams 64 of the first BOP 184A to a closed configuration 209. Similarly, the operator may provide an open input to the first open input device 208A, which may cause a flow of hydraulic ram fluid 118 to a respective portion of the first BOP 184A to transition or drive the rams 64 of the first BOP 184A to the open configuration 211. It should be appreciated that the operator may provide separate inputs to selectively open and close any of the BOPs 38, such as based on desired operational effects (e.g., shearing, sealing, blind sealing). Thus, as shown in FIG. 5, the first BOP 184A is in the closed configuration 209, while the second BOP 184B and the third BOP 184C are in the open configuration 211.

Further, each BOP 38 is associated with a respective pilot block 210, such as a first pilot block 210A for the first BOP 184A, a second pilot block 210B for the second BOP 184B, and a third pilot block 210C for the third BOP 184C. Each pilot block 210 is actuated via pressure applied via a respective close line 202. For example, the first pilot block 210A is fluidly coupled to the first close line 202A and actuated by sufficient pressure (e.g., a target or threshold pressure) within the first close line 202A, the second pilot block 210B is fluidly coupled to the second close line 202B and actuated by sufficient pressure (e.g., a target or threshold pressure) within the second close line 202B, and the third pilot block 210C is fluidly coupled to the third close line 202C and actuated by sufficient pressure (e.g., a target or threshold pressure) within the third close line 202C. The sufficient pressure corresponds to a target or threshold pressure to transition the respective BOP 38 from the closed configuration 209 to the closed and locked configuration 148 (in FIG. 3), thus the respective pilot block 210 is actuated in response to (e.g., only during) the respective BOP 38 being in the closed configuration 209.

Each pilot block 210 also includes a first check valve 212 and a second check valve 214. The first check valve 212 is fluidly coupled to a lock line 216, and the second check valve 214 is fluidly coupled to an unlock line 218. In operation, the operator may provide a lock input to a lock input device 220, which may cause a flow of hydraulic motor fluid 117 through the lock line 216 toward the pilot blocks 210. Similarly, the operator may provide an unlock input to an unlock input device 222, which may cause a flow of hydraulic motor fluid 117 through the unlock line 218 toward the pilot blocks 210.

As noted herein, each pilot block 210 is actuated (e.g. opened) in response to sufficient pressure in the respective close line 202. Accordingly, the flow of hydraulic motor fluid 117 may flow through the lock line 216 to actuate respective lock members while (e.g., as long as; only while) there is sufficient pressure in the respective close line 202. Further, as noted herein, the sufficient pressure corresponds to an amount of pressure that is applied to (e.g., effective to) adjust the respective BOP 38 to the closed configuration 209. Thus, the flow of hydraulic motor fluid 117 may flow through the lock line 216 to actuate respective lock members while (e.g., as long as; only while) the respective BOP 38 is in the closed configuration 209. For example, upon the close input at the first close input device 206A, pressure may be applied through the first close line 202A. Once the pressure within the first close line 202A drives the first BOP 184A to the closed configuration 209, the pressure may build within the first close line 202A as shown by arrow 224 and actuate the first pilot block 210. Thus, the flow of hydraulic motor fluid 117 may flow through the lock line 216 (e.g., and through the motor fluid circuit 110) as shown by arrow 226 to drive the respective lock members for the first BOP 184A to lock the first BOP 184A in the closed and locked configuration.

Advantageously, the first BOP 184A may be locked independently of the second BOP 184B and the third BOP 184C due to presence of the respective pilot blocks 210 that are each coupled to the respective close lines 202. For example, because the second close input device 206B and the third close input device 206C are not selected at the control panel 205, there is not sufficient pressure present in the second close line 202B and the third close line 202C. Thus, the second pilot block 210B and the third pilot block 210C are not actuated and block the flow of the hydraulic fluid through the respective check valves 212, 214 of the second pilot block 210B and the third pilot block 210C.

Accordingly, even though the operator provided the lock input to the lock input device 220, the flow of the hydraulic fluid in the lock line 216 does not travel across the second pilot block 210B and the third pilot block 210C and does not reach the respective BOP systems 182 for the second BOP 184B and the third BOP 184C. As described herein, this may provide various advantages, such as blocking the respective BOP systems 182 from driving the second BOP 184B and the third BOP 184C to the closed and locked configuration (e.g., in absence of respective close inputs to the second close input device 206B and the third close input device 206C).

Figure 6:
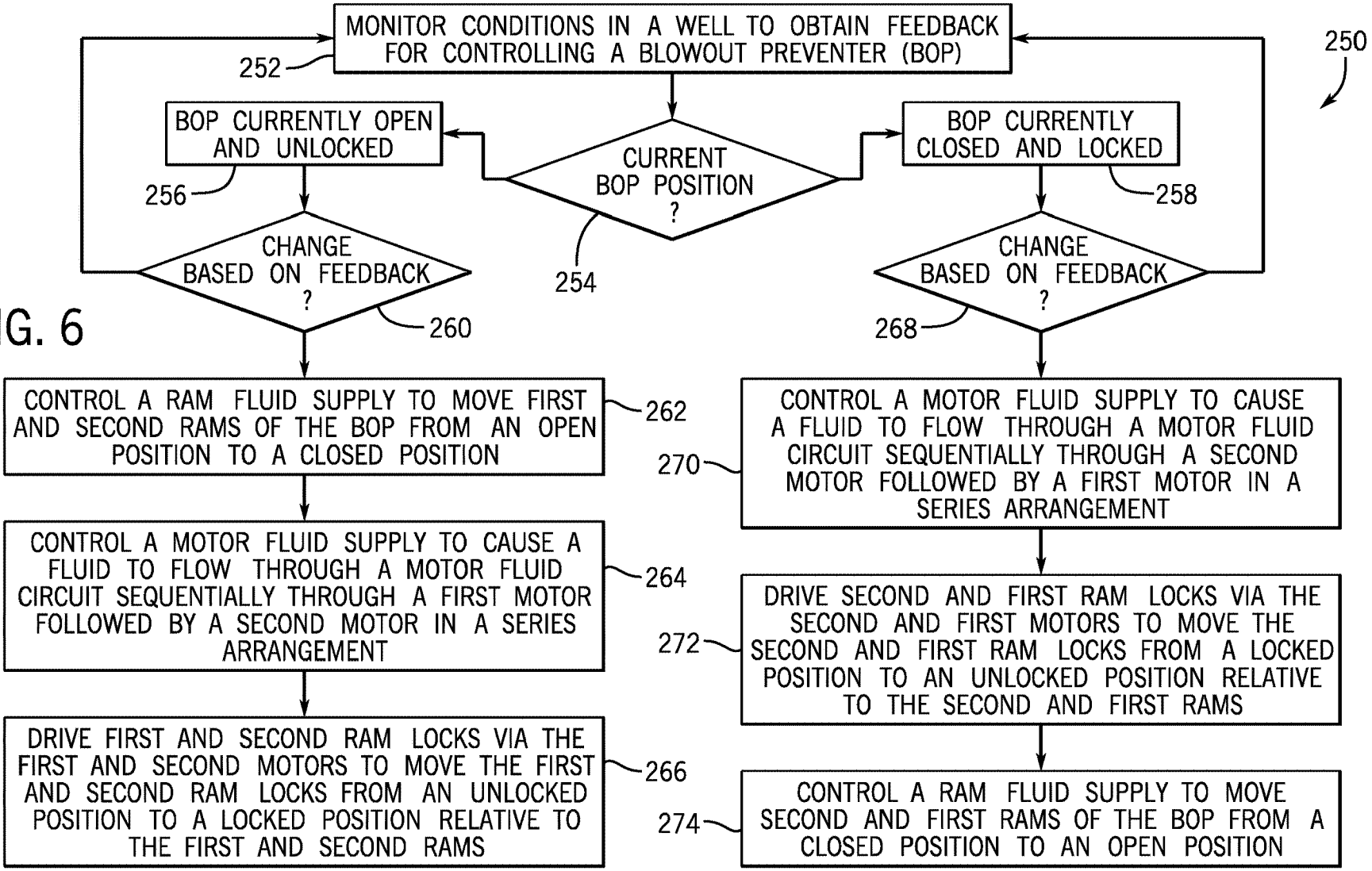
FIG. 6 is a flowchart showing an example process of operating the BOP system of FIG. 1, according to an embodiment of the present disclosure.

FIG. 6 is a flowchart showing an example process 250 of operating the BOP locking system 40 of FIG. 1. The process 250 may be performed by the controller 90 in FIG. 2 or any other suitable computing device(s) or controller(s). Furthermore, the actions of the process 250 may be performed in the order disclosed herein or in any other suitable order. For example, certain actions of the process 250 may be performed concurrently. In addition, in certain embodiments, at least one of the actions of the process 250 may be omitted.

In block 252 of the process 250, the controller may monitor conditions in a well to obtain feedback for controlling a BOP. In certain embodiments, the controller may receive a signal from one or more sensors disposed in the well indicative of one or more parameters of the production fluid produced by the well. For example, the controller may determine a pressure of the well fluid in the well based on a signal received from one or more sensors disposed in the well.

In block 254 of the process 250, the controller may determine the current state of the BOP. In certain embodiments, the controller may receive one or more signals from one or more sensors coupled to the locks and/or the pistons of the BOP system. Based on the one or more signals, the controller may determine whether the pistons are in the open or closed position (e.g., whether the rams are extended), as well as whether the locks are in the locked or unlocked position. In block 256, the controller may determine that the pistons of the BOP are currently open and that the locks are currently unlocked. That is, the controller may determine that the BOP is in an open and unlocked state. In the block 258, the controller may determine that the pistons of the BOP are currently closed and that the locks are currently locked. That is, the controller may determine that the BOP is in a closed and locked state. If the controller determines that the BOP is in either a closed and unlocked state or an open and locked state, the controller may provide a notification of a possible malfunction.

In block 260 of the process 250, the controller may determine whether the BOP state should change based on the feedback received by the controller in the block 252. In certain embodiments, the controller may determine whether a determined estimated pressure of the production fluid in the well exceeds a threshold pressure. In response to the determined estimated pressure exceeding the threshold pressure and the BOP currently being in an open and unlocked state, the controller may determine a change in the state of the BOP.

In block 262 of the process 250, the controller may control the ram fluid supply to move the first and second rams of the BOP from an open position to a closed position. In certain embodiments, the controller may control the ram fluid supply to transport a fluid (e.g., hydraulic fluid, hydraulic ram fluid) to the first and second cylinders that house the first and second pistons, respectively. In response to the first and second cylinders receiving the fluid, the first and second pistons may extend from an open position to a closed position, thereby driving the first and second rams into the wellbore to block passage of the production fluid through the wellbore of the BOP.

In block 264 of the process 250, the controller may control a motor fluid supply to cause a fluid (e.g., motor fluid, motor hydraulic fluid) to flow through a motor fluid circuit sequentially through a first motor followed by a second motor, the first and second motors arranged in a series arrangement. In certain embodiments, the fluid may flow through a first supply conduit from the motor fluid supply to the first motor. Additionally or alternatively, the fluid may flow through a connector conduit from the first motor to the second motor. Additionally or alternatively, the fluid may flow through a second supply conduit from the second motor back to the motor fluid supply.

In block 266 of the process 250, the controller may drive first and second locks (e.g., first and second ram locks) via the first and second motors to move the first and second locks from an unlocked position to a locked position relative to the first and second rams. In certain embodiments, the first motor may cause the first lock (e.g., first rotary lock) to extend and abut a first outer axial side of the first piston, thereby securing (e.g., locking) the first piston and the first ram at least in the radial direction. Additionally or alternatively, the second motor may cause the second lock (e.g., second rotary lock) to extend and abut a second outer axial side of the second piston, thereby securing the second piston and the second ram at least in the radial direction.

In block 268 of the process 250, the controller may determine whether the BOP state should change based on the feedback received by the controller in the block 252. In certain embodiments, the controller may determine whether a determined estimated pressure of the production fluid in the well falls below a threshold pressure. In response to the determined estimated pressure falling below the threshold pressure and the BOP currently being in a closed and locked state, the controller may determine a change in the state of the BOP.

In block 270 of the process 250, the controller may control a motor fluid supply to cause a fluid (e.g., motor fluid, motor hydraulic fluid) to flow through a motor fluid circuit sequentially through a second motor followed by a first motor, the first and second motors arranged in a series arrangement. In certain embodiments, the fluid may flow through the second supply conduit from the motor fluid supply to the second motor. Additionally or alternatively, the fluid may flow through the connector conduit from the second motor to the first motor. Additionally or alternatively, the fluid may flow through the first supply conduit from the first motor back to the motor fluid supply.

In block 272 of the process 250, the controller may drive second and first locks (e.g., second and first ram locks) via the second and first motors to move the second and first locks from the locked position to the unlocked position relative to the second and first rams. In certain embodiments, the second motor may cause the second lock (e.g., second rotary lock) to retract from the second outer axial side of the second piston, thereby unlocking the second piston and the second ram at least in the radial direction. Additionally or alternatively, the first motor may cause the first lock (e.g., first rotary lock) to retract from the first outer axial side of the first piston, thereby unlocking the first piston and the first ram at least in the radial direction.

In block 274 of the process 250, the controller may control the ram fluid supply to move the first and second rams of the BOP from the closed position to the open position. In certain embodiments, the controller may control the ram fluid supply to transport a fluid (e.g., hydraulic fluid, hydraulic ram fluid) to the first and second cylinders that house the first and second pistons, respectively. In response to the first and second cylinders receiving the fluid, the first and second pistons may move from the closed position to the open position, thereby driving the first and second rams out of the wellbore to unblock the wellbore and enable passage of the production fluid through the wellbore.

Technical effects of the present disclosure include a series arrangement of motors in a BOP stack used for locking (e.g., securing) one or more rams. As discussed herein, two or more motors are arranged in a series arrangement such that hydraulic fluid flows through each of the motors sequentially, thereby reducing the amount of hydraulic fluid used for locking and/or unlocking the motors. Additionally, the series arrangement of the motors reduces the number of hoses and hose connections, thereby mitigating leakage of the hydraulic fluid. Additionally, the series arrangement of the motors reduces the number of flow regulators used for regulating the flow of the hydraulic fluid through the motors. Due to the reduction in amount of hydraulic fluid and the amount of equipment, the overall cost of operating the BOP locking system is reduced.

The subject matter described in detail above may be defined by one or more clauses, as set forth below.

A system includes a blowout preventer (BOP) having a ram assembly having first and second pistons. The first piston is configured to drive a first ram into a cavity of the BOP and the second piston is configured to drive a second ram into the cavity. The system also includes a motor assembly having first and second motors. The first motor is configured to cause an extension of a first lock to constrain the first piston and the second motor is configured to cause an extension of a second lock to constrain the second piston. The first and second motors are fluidly coupled to each other in a series arrangement via a connector conduit. The connector conduit is configured to flow a motor fluid sequentially through the first and second motors.

The system of the preceding clause, wherein the motor assembly includes a motor fluid supply, wherein the motor fluid supply is fluidly coupled to the first and second motors, the motor fluid supply configured to supply a motor fluid to the first and second motors in the series arrangement.

The system of any preceding clause, wherein the first lock is configured to extend toward the first piston to constrain the first ram in response to the first motor receiving the motor fluid from the motor fluid supply, wherein the second lock is configured to extend toward the second piston to constrain the second ram in response to the second motor receiving the motor fluid from the first motor via the connector conduit.

The system of any preceding clause, wherein the second lock is configured to retract from the second piston in response to the second motor receiving the motor fluid from the motor fluid supply, wherein the first lock is configured to retract from the first piston in response to the first motor receiving the motor fluid from the second motor via the connector conduit.

The system of any preceding clause, wherein the first lock is configured to extend from a first unlocked position to a first locked position in response to the first motor receiving the motor fluid from the motor fluid supply, wherein the second lock is configured to extend from a second unlocked position to a second locked position in response to the second motor receiving the motor fluid from the first motor via the connector conduit.

The system of any preceding clause, wherein the first piston is configured to drive the first ram from a first open position to a first closed position, the first ram at least partially disposed in the cavity at the first closed position, wherein the second piston is configured to drive the second ram from a second open position to a second closed position, the second ram at least partially disposed in the cavity at the second closed position.

The system of any preceding clause, wherein the ram assembly includes a ram fluid supply, wherein the ram fluid supply is fluidly coupled to the first and second pistons, the ram fluid supply configured to supply a ram fluid to the first and second pistons, wherein the first and second pistons are configured to extend in response to receiving the ram fluid.

The system of any preceding clause, including a motor fluid circuit, wherein the motor fluid circuit includes: the first motor coupled to the second motor via the connector conduit; the first motor coupled to a motor fluid supply via a first supply conduit; and the motor fluid supply coupled to the second motor via a second supply conduit.

The system of any preceding clause, wherein the first lock, the second lock, or a combination thereof includes a rotary lock.

The system of any preceding clause, wherein the first motor, the second motor, or a combination thereof includes a rotary motor.

A system includes a lock system for a blowout preventer (BOP). The lock system includes a lock assembly having first and second locks. The first lock is configured to selectively lock a first ram of a ram assembly extended into a cavity of the BOP. The second lock is configured to selectively lock a second ram of the ram assembly extended into the cavity of the BOP. The lock system also includes a motor assembly having first and second motors. The first motor is configured to cause the first lock to constrain the first ram. The second motor is configured to cause the second lock to constrain the second ram. The first and second motors are fluidly coupled to each other in a series arrangement via a connector conduit. The connector conduit is configured to flow a motor fluid sequentially through the first and second motors.

The system of the preceding clause, including first and second pistons, wherein the first piston is configured to drive the first ram into the cavity, the second piston is configured to drive the second ram into the cavity.

The system of any preceding clause, wherein the first lock extends to constrain the first ram in response to the first motor receiving the motor fluid from a motor fluid supply, wherein the second lock extends to constrain the second ram in response to the second motor receiving the motor fluid from the first motor via the connector conduit.

The system of any preceding clause, wherein the second lock is configured to retract from the second piston in response to the second motor receiving the motor fluid from the motor fluid supply, wherein the first lock is configured to retract from the first piston in response to the first motor receiving the motor fluid from the second motor via the connector conduit.

The system of any preceding clause, wherein the ram assembly includes a ram fluid supply, wherein the ram fluid supply is fluidly coupled to the first and second pistons, the ram fluid supply configured to supply a ram fluid to the first and second pistons.

The system of any preceding clause, wherein the motor assembly includes a motor fluid supply, wherein the motor fluid supply is fluidly coupled to the first and second motors, the motor fluid supply configured to supply the motor fluid to the first and second motors in the series arrangement.

The system of any preceding clause, including a controller, the controller having a memory and a processor, wherein the controller is configured to control the motor fluid supply to cause the motor fluid to flow sequentially through the first and second motors in the series arrangement selectively in opposite first and second flow directions.

The system of any preceding clause, including: an additional ram assembly having additional first and second rams, the additional first and second rams configured to extend into an additional cavity of an additional BOP; and an additional motor assembly having additional first and second motors, wherein the additional first motor is configured to cause an additional first lock to constrain the additional first ram, the additional second motor is configured to cause an additional second lock to constrain the additional second ram; wherein the additional first and second motors are fluidly coupled to each other in an additional series arrangement via an additional connector conduit, the additional connector conduit configured to flow an additional motor fluid sequentially through the additional first and second motors; wherein the controller is configured to control an additional motor fluid supply to cause the additional motor fluid to flow sequentially through the additional first and second motors.

A method includes monitoring conditions in a well to obtain feedback for controlling a blowout preventer (BOP). The method also includes determining a current state of the BOP. The method also includes, in response to determining the BOP to be in an open state and unlocked state, and in response to the feedback meeting a condition for closing the BOP: controlling a ram fluid supply to move first and second rams of the BOP from an open position to a closed position; controlling a motor fluid supply to cause a motor fluid to flow through a motor fluid circuit sequentially through a first motor followed by a second motor; and driving first and second locks via the first and second motors to move the first and second locks from an unlocked position to a locked position relative to the first and second rams. The first and second motors are arranged in a series arrangement.

The method of the preceding clause, including, in response to determining the BOP to be in a closed state and a locked state: controlling the motor fluid supply to cause the motor fluid to flow through the motor fluid circuit sequentially through the second motor followed by the first motor; driving the first and second locks via the first and second motors to move the first and second locks from the locked position to the unlocked position relative to the first and second rams; and controlling the ram fluid supply to move the first and second rams of the BOP from the closed position to the open position.

The foregoing description, for purpose of explanation, has been described with reference to specific embodiments. However, the illustrative discussions above are not intended to be exhaustive or to limit the disclosure to the precise forms disclosed. Many modifications and variations are possible in view of the above teachings. Moreover, the order in which the elements of the methods described herein are illustrated and described may be re-arranged, and/or two or more elements may occur simultaneously. The embodiments were chosen and described in order to best explain the principles of the disclosure and its practical applications, to thereby enable others skilled in the art to best utilize the disclosure and various embodiments with various modifications as are suited to the particular use contemplated.

Finally, the techniques presented and claimed herein are referenced and applied to material objects and concrete examples of a practical nature that demonstrably improve the present technical field and, as such, are not abstract, intangible or purely theoretical.

The invention claimed is:

1. A system, comprising:

a lock system for a blowout preventer (BOP), comprising:

a lock assembly comprising first and second locks, wherein the first lock is configured to selectively lock a first ram of a ram assembly extended into a cavity of the BOP, and the second lock is configured to selectively lock a second ram of the ram assembly extended into the cavity of the BOP;

a motor assembly comprising:

first and second motors, wherein the first motor is configured to cause the first lock to constrain the first ram, and the second motor is configured to cause the second lock to constrain the second ram, and wherein the first and second motors are fluidly coupled to each other in a series arrangement via a connector conduit, the connector conduit being configured to flow a motor fluid sequentially through the first and second motors; and a motor fluid supply fluidly coupled to the first and second motors, the motor fluid supply being configured to supply the motor fluid to the first and second motors in the series arrangement; and a controller, the controller comprising a memory and a processor, wherein the controller is configured to control the motor fluid supply to cause the motor fluid to flow sequentially through the first and second motors in the series arrangement selectively in opposite first and second flow directions.

2. The system of claim 1, further comprising a motor fluid circuit, wherein the motor fluid circuit comprises:

the first motor coupled to the second motor via the connector conduit;

the first motor coupled to the motor fluid supply via a first supply conduit; and the motor fluid supply coupled to the second motor via a second supply conduit.

3. The system of claim 1, wherein the first lock, the second lock, or a combination thereof comprises a rotary lock.

4. The system of claim 1, wherein the first motor, the second motor, or a combination thereof comprises a rotary motor.

5. The system of claim 1, further comprising first and second pistons, wherein the first piston is configured to drive the first ram into the cavity, and the second piston is configured to drive the second ram into the cavity.

6. The system of claim 5, wherein the first lock extends to constrain the first ram in response to the first motor receiving the motor fluid from the motor fluid supply, and wherein the second lock extends to constrain the second ram in response to the second motor receiving the motor fluid from the first motor via the connector conduit.

7. The system of claim 6, wherein the second lock is configured to retract from the second piston in response to the second motor receiving the motor fluid from the motor fluid supply, and wherein the first lock is configured to retract from the first piston in response to the first motor receiving the motor fluid from the second motor via the connector conduit.

8. The system of claim 7, wherein the ram assembly comprises a ram fluid supply, and wherein the ram fluid supply is fluidly coupled to the first and second pistons, the ram fluid supply being configured to supply a ram fluid to the first and second pistons.

9. The system of claim 1, further comprising:

an additional ram assembly comprising additional first and second rams, the additional first and second rams being configured to extend into an additional cavity of an additional BOP; and an additional motor assembly comprising additional first and second motors, wherein the additional first motor is configured to cause an additional first lock to constrain the additional first ram, and the additional second motor is configured to cause an additional second lock to constrain the additional second ram;

wherein the additional first and second motors are fluidly coupled to each other in an additional series arrangement via an additional connector conduit, the additional connector conduit being configured to flow an additional motor fluid sequentially through the additional first and second motors; and wherein the controller is configured to control an additional motor fluid supply to cause the additional motor fluid to flow sequentially through the additional first and second motors.

* * * * *